US008272886B2

(12) United States Patent
Seido

(10) Patent No.: US 8,272,886 B2
(45) Date of Patent: Sep. 25, 2012

(54) CONNECTOR

(75) Inventor: Syogo Seido, Tokyo (JP)

(73) Assignee: Join Co., Ltd., Tokyo (JP)

( * ) Notice: Subject to any disclaimer, the term of this patent is extended or adjusted under 35 U.S.C. 154(b) by 0 days.

(21) Appl. No.: 13/138,513

(22) PCT Filed: Nov. 13, 2009

(86) PCT No.: PCT/JP2009/069380

§ 371 (c)(1),
(2), (4) Date: Aug. 29, 2011

(87) PCT Pub. No.: WO2011/058649

PCT Pub. Date: May 19, 2011

(65) Prior Publication Data

US 2011/0312206 A1 Dec. 22, 2011

(51) Int. Cl.
*H01R 13/621* (2006.01)

(52) U.S. Cl. ..... 439/352

(58) Field of Classification Search ..... 439/352, 439/595

See application file for complete search history.

(56) References Cited

U.S. PATENT DOCUMENTS

| | | | | |
|---|---|---|---|---|
| 3,644,871 | A * | 2/1972 | Lafont | 439/348 |
| 5,425,653 | A * | 6/1995 | Koiso | 439/347 |
| 5,993,238 | A | 11/1999 | Kudo et al. | |
| 6,602,086 | B2 * | 8/2003 | Tsuji et al. | 439/352 |

FOREIGN PATENT DOCUMENTS

| | | | |
|---|---|---|---|
| JP | 62-18979 | U | 2/1987 |
| JP | 7-263072 | A | 10/1995 |
| JP | 9-237653 | A | 9/1997 |
| JP | 3109620 | | 3/2005 |
| JP | 2009-230924 | A | 10/2009 |

OTHER PUBLICATIONS

International Search Report (ISR) (PCT Form PCT/ISA/210) dated Dec. 28, 2009, with partial English translation.

* cited by examiner

*Primary Examiner* — Briggitte R Hammond
(74) *Attorney, Agent, or Firm* — McGinn IP Law Group, PLLC

(57) ABSTRACT

A connector capable of being water-tightly secured to cables without locally applying pressure to the cables is provided. A male connector 14 is formed with at least one guide groove 18*m* extending in an insertion direction on a portion in a circumferential direction, a female connector 16 is formed with at least one guide protrusion 20*m* that extends in the insertion direction and can be inserted into the guide groove 18*m* corresponding to the guide groove 18*m*, the guide protrusion 20*m* has both ends coupled to an outer surface of the second connector 16, a middle portion of the guide protrusion 20*m* is formed to be an elastic arm separated from the outer surface, and a lock mechanism is provided between the guide groove 18*m* and the guide protrusion 20*m*.

6 Claims, 15 Drawing Sheets

CONNECTOR

TECHNICAL FIELD

The invention relates to a connector for connecting connection ends of cables, that is excellent in locking performance and waterproofness.

BACKGROUND ART

As a conventional connector, a push-pull connector described in Patent Document 1, for example, is known.

The push-pull connector includes a male connector and a female connector, wherein levers extending toward directions in which the male connector and the female connector are connected are respectively provided on the male connector and the female connector, either one of the levers is formed to be a flexible arm, either one of the levers is formed with a lock claw and a second claw, the other one of the levers is formed with a lock hole with which the lock claw engages, and a lock-releasing ring for pressing the second claw toward the center is loosely fit to the outer side of the male connector and the female connector so as to allow it to slide in a longitudinal direction.

To connect the connector, the male connector and the female connector are made to approach each other so that the lock claw on one of the levers engages with the lock hole of the other lever, which leads the locking of the connection of the connector. To release the connector, the lock-releasing ring is slid to push the second claw so as to release the engagement between the lock claw and the lock hole. Under this condition, the male and female connectors are pulled in directions opposite to connecting directions, whereby the connection can be released.

The connector is secured to the cable as follows. That is, rubber tubes are fitted on the outer surfaces of the connection parts of the cables, and a plurality of claws are formed by comb-shaped notches on the outer ends of tubular bodies provided on the ends of the male connector and the female connector. When cap nuts are screwed on the tubular body of the male connector and the female connector respectively, the plurality of claws bend inwardly so as to bite into the outer surfaces of the rubber tubes, whereby the cables can be coupled to the male connector and the female connector strongly enough to prevent the cables from being disconnected therefrom as well as water-tightly.

PRIOR ART DOCUMENT

Patent Document

Patent Document 1: Japanese Registered Utility Model No. 3109620

SUMMARY OF INVENTION

Technical Problem

However, in the conventional connector, the lock is released by sliding the lock-releasing ring, and thus there may be a risk that the coupling is inadvertently released by an erroneous operation. Also, since the lock-releasing ring is provided on the outer side of the connector, the compactness of the connector is limited.

In addition, the connection and lock structure of the male connector and the female connector requires a separate guide for aligning the levers on the male connector and the female connector in the circumferential direction.

Further, in the securing structure with the cables, the claws formed on the outer ends of the tubular body provided on the ends of the male connector and the female connector bite into the outer surfaces of the rubber tubes, and correspondingly, local dents are problematically formed on the outer surfaces of the cables. It means that stress is locally concentrated on the cables, which is not preferable.

The invention has been accomplished in view of the above defects and the object thereof is to provide a connector capable of solving the defects of the conventional connector.

More specifically, the object of the invention is to provide a connector having an improved connection and lock structure of a male connector and a female connector. Another object of the invention is to provide a connector having an improved cable securing structure capable of being water-tightly secured to cables without applying local pressure to the cables.

Solution to Problem

To accomplish the above objects, the invention is a connector that includes a first connector and a second connector having a sleeve shape and coupled to connection ends of cables to be connected to each other, the connection end of either one of the first connector and the second connector being inserted into the connection end of the other one thereof so that the cables are connected to each other, wherein the first connector is provided with at least one guide groove extending in an insertion direction on a portion in a circumferential direction, and the second connector is provided with at least one guide protrusion that extends in the insertion direction and can be inserted into the guide groove corresponding to the guide groove, the guide protrusion has both ends coupled to an outer surface of the second connector, and a middle portion thereof is formed to be an elastic arm separated from the outer surface, and a lock mechanism is provided between the guide groove and the guide protrusion.

The lock mechanism may include a lock hole formed from the guide groove and a lock claw that is formed on the guide protrusion and can engage with the lock hole.

The lock claw may be provided on each of both sides of the guide protrusion and the lock claw and the lock hole can engage with each other on both sides of the guide protrusion.

An end surface on a side opposite to connection end of the lock claw is preferably inclined toward an inner diameter direction, and an engagement surface of the lock hole engaging with the end surface is inclined toward an outer diameter direction.

It is possible that each of the first connector and the second connector includes:

a body;

a nut screwed on an end portion on opposite-to-connection side of the body; and a tubular packing which is located inside the body and through which the cable is inserted, wherein the tubular packing is compressed in an axial direction as the nut is screwed on the body so as to water-tightly contact the cable with pressure.

It is possible that a stepped portion that abuts on one end of the tubular packing is provided in the body, and a tubular protrusion protruding in the axial direction is formed inside the nut so as to abut on the other end of the tubular packing.

The stepped portion and a protruding end surface of the tubular protrusion are preferably formed as inclined surfaces that are inclined to face an inner diameter side.

A plurality of protrusions may be formed on a circumferential surface of the body separately in the circumferential direction, a plurality of protrusions may be formed on a circumferential surface of the nut, and the nut and the body may rotate relatively to each other while the protrusion of the nut interferes with the protrusion of the body as the nut is screwed on the body.

Advantageous Effects of Invention

According to the invention, a guide groove and a guide protrusion are provided, and a lock mechanism is provided between the guide groove and the guide protrusion so that the guide function and the lock function can share a small space and then the connector can be made compact.

The insertion of the guide protrusion into the guide groove can prevent inadvertent release of the lock. The guide protrusion has both ends coupled to the outer surface of the second connector to be formed as an elastic arm, and thus is not easily broken and can improve locking force.

In addition, the lock claws are formed on both sides of the guide protrusion so that the lock claws and the lock holes engage with each other on both sides of the guide protrusion, whereby the locking force can be improved. In particular, there can be provided a structure allowing the first connector and the second connector to be hardly released even when they are respectively pulled leftward and rightward from each other.

In addition, the end surface of the lock claw and the wall surface of the lock hole with which the end surface engages are formed as inclined surfaces, and thus there can be provided a structure allowing the first connector and the second connector to be more hardly released.

Since the tubular packing is compressed in the axial direction between the body and the nut, whole of the tubular packing expands toward the inner diameter side and the outer diameter side and contacts the cables and the body with pressure. Therefore, the connector can be secured to the cables without applying local pressure to the cables.

DESCRIPTION OF EMBODIMENTS

Embodiments of the invention will be described hereinafter with reference to the drawings.

First Embodiment

Figure 1A:
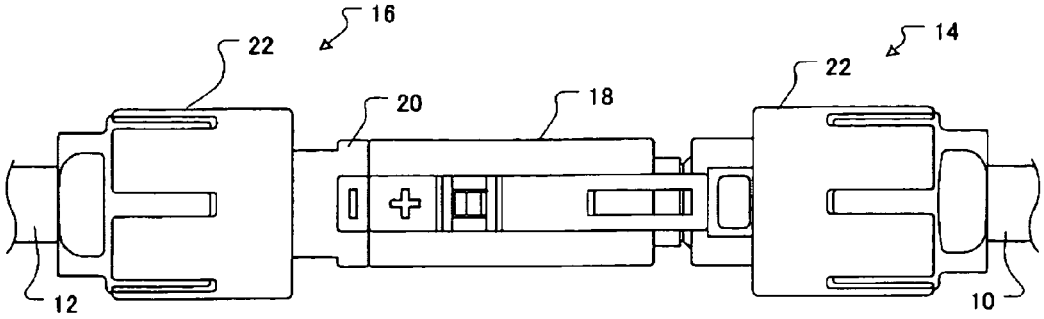
FIG. 1A is a plan view of a connector in a connection condition according to a first embodiment of the invention.
Figure 1B:
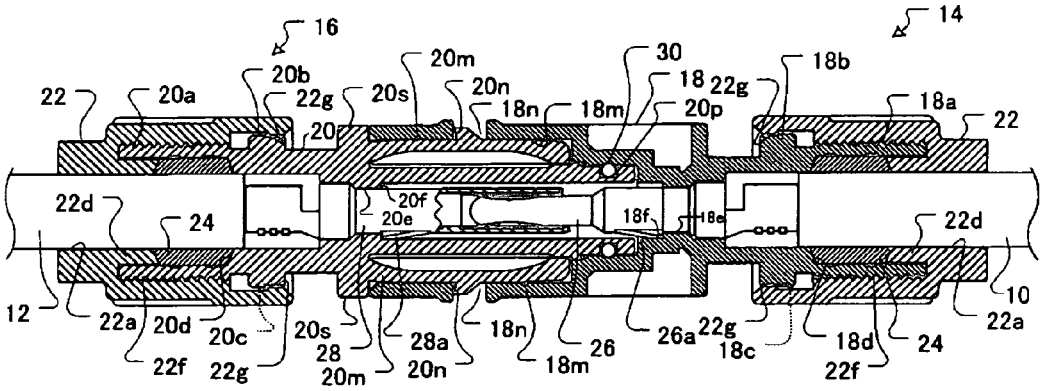
FIG. 1B is a longitudinal sectional view of the connector in a connection condition according to the first embodiment of the invention.
Figure 1C:
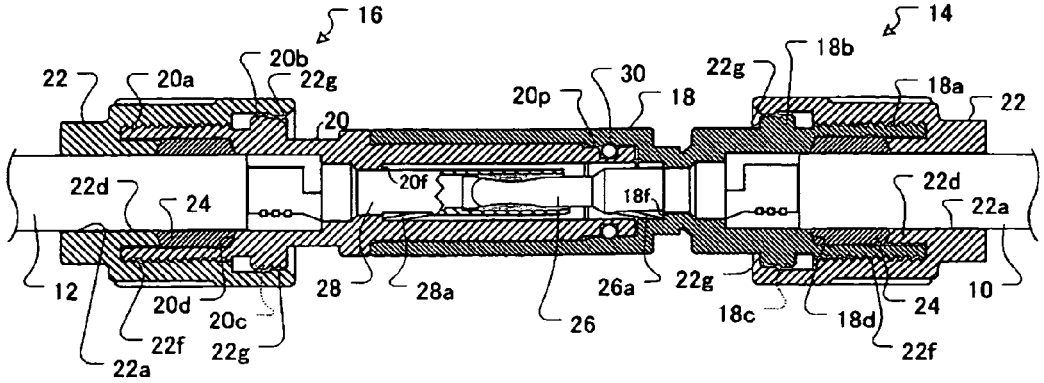
FIG. 1C is a longitudinal sectional view of the connector in a connection condition according to the first embodiment of the invention as viewed from a section rotating 90 degrees from the section used in FIG. 1B.
Figure 2A:
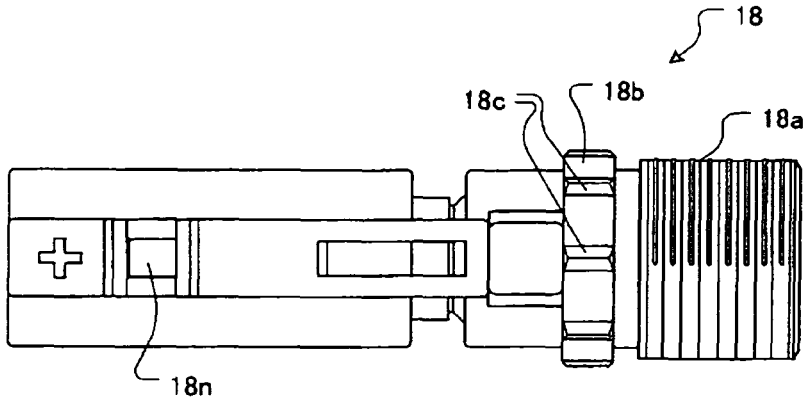
FIG. 2A is a plan view of a male connector body.
Figure 2B:
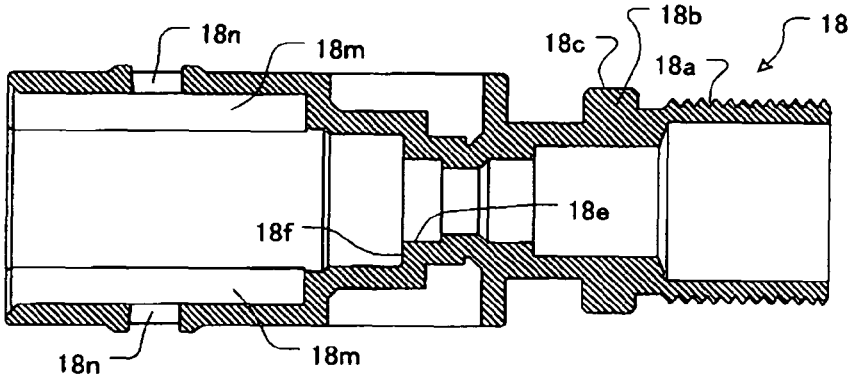
FIG. 2B is a longitudinal sectional view of the male connector body.
Figure 2C:
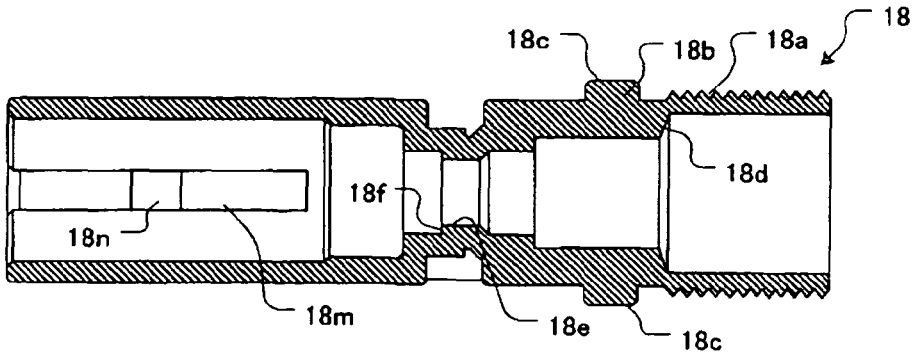
FIG. 2C is a longitudinal sectional view of the male connector body viewed from a section rotating 90 degrees from the section used in FIG. 2B.
Figure 2D:
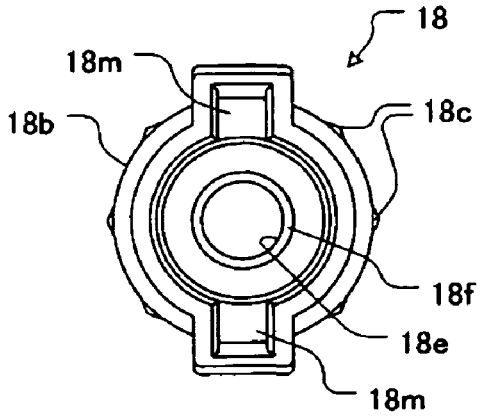
FIG. 2D is a view of the male connector body viewed from a connection end side.

FIGS. 1A to 1C are views showing a connector according to a first embodiment of the invention. The connector can be a connector for connecting a cable connected to a solar panel to another cable, for example.

As shown in FIGS. 1A to 1C, the connector of the embodiment includes a male connector 14 and a female connector 16 respectively coupled to connection ends of cables 10 and 12 that are to be connected to each other.

Figure 4:
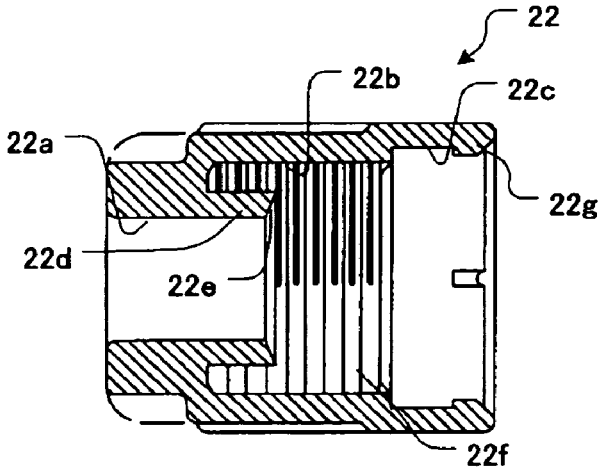
FIG. 4 is a sectional view of a nut.
Figure 5A:
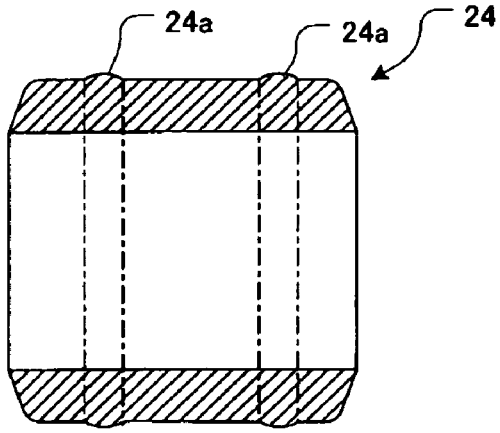
FIG. 5 is a sectional view of a tubular packing.
FIG. 5B is a side view of the tubular packing.
Figure 5B:
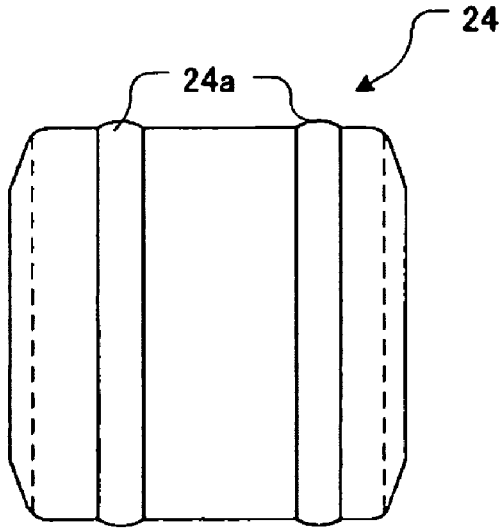
Figure 6:
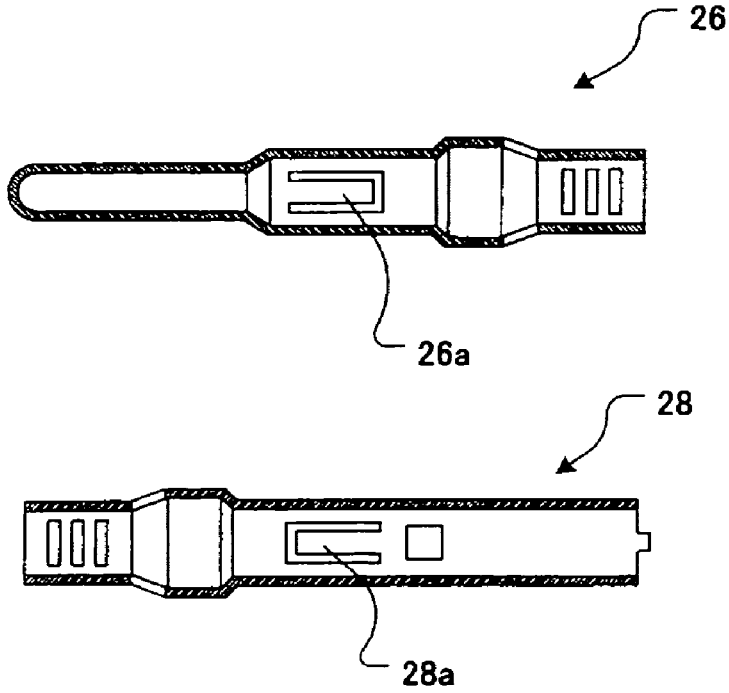
FIG. 6 is a sectional view showing a male contact and a female contact.

The male connector 14 of a generally sleeve shape includes a male connector body 18 shown in FIGS. 2A to 2D, a nut 22 shown in FIG. 4, and a tubular packing 24 shown in FIGS. 5A and 5B.

Figure 3A:
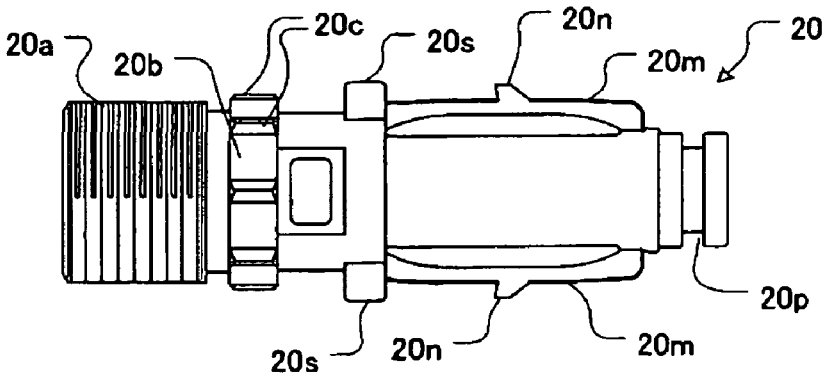
FIG. 3A is a side view of a female connector body.
Figure 3B:
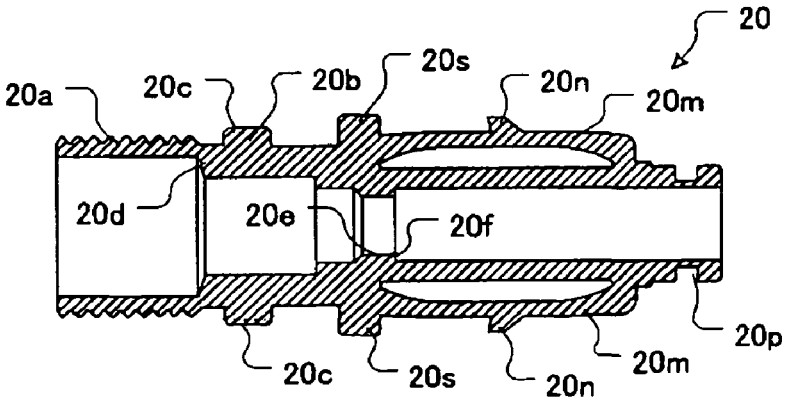
FIG. 3B is a longitudinal sectional view of the female connector body.
Figure 3C:
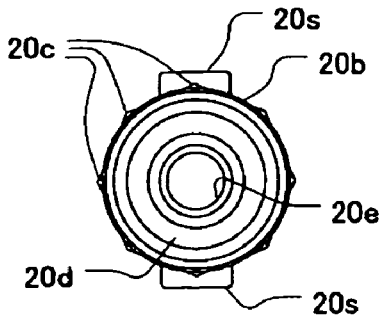
FIG. 3C is a view of the female connector body viewed from a connection end side.

Similarly, the female connector 16 of a generally sleeve shape includes a female connector body 20 shown in FIGS. 3A to 3C, a nut 22 shown in FIG. 4, and a tubular packing 24 shown in FIGS. 5A and 5B.

(Cable Securing Structure)

The male connector 14 is configured to be water-tightly secured to the cable 10 by means of an end portion on opposite-to-connection side of the male connector body 18, the nut 22, and the tubular packing 24. With a similar structure, the female connector 16 is configured to be water-tightly secured to the cable 12 by means of an end portion on opposite-to-connection side of the female connector body 20, the nut 22, and the tubular packing 24. The securing structure will be described in detail hereinafter.

On the outer surface of the male connector body 18 on the side opposite to connection end, a male thread portion 18*a* is formed. On the connection end side from the male thread portion 18*a*, an enlarged diameter portion 18*b* which is enlarged from the male thread portion 18*a* to the outer diameter side is formed. On the outer surface of the enlarged diameter portion 18*b*, a plurality of (eight, in the embodiment) small protrusions 18*c* are formed separately in the circumferential direction.

On the inner surface of the male connector body 18 on the side opposite to connection end, a stepped portion 18*d* inclined to face the side opposite to connection end and the inner diameter side is formed as viewed from the side opposite to connection end.

Similarly, on the outer surface of the female connector body 20 on the side opposite to connection end, a male thread portion 20*a* is formed. On the connection end side from the male thread portion 20*a*, an enlarged diameter portion 20*b* which is enlarged from the male thread portion 20*a* to the outer diameter side is formed. On the outer surface of the enlarged diameter portion 20*b*, a plurality of (eight, in the embodiment) small protrusions 20*c* are formed separately in the circumferential direction.

On the inner surface of the female connector body 20 on the side opposite to connection end, a stepped portion 20*d* inclined to face the side opposite to connection end and the inner diameter side is formed as viewed from the side opposite to connection end. The stepped portion 20*d* is inclined to face the inner diameter side.

As shown in FIG. 4, a center hole formed inside the nut 22 is composed of a small diameter hole 22*a* that allows the cables 10 and 12 to pass therethrough and has a diameter almost the same as or larger than the outer diameter of the cables 10 and 12, a large diameter hole 22*b* having a diameter larger than that of the small diameter hole 22*a*, and a tip end hole 22*c* having a diameter slightly larger than that of the large diameter hole 22*b*.

A tubular protrusion 22*d* extends from the end of the small diameter hole 22*a* toward the tip end hole 22*c*, and the tubular protrusion 22*d* is concentrically arranged inside the large diameter hole 22*b*. A protruding end surface 22*e* of the tubular protrusion 22*d* is inclined to face the inner diameter side.

On the inner surface of the large diameter hole 22*b*, a female thread 22*f* is formed. The female thread 22*f*, may be formed continuously, or may be formed discretely.

On the tip end of the inner surface of the large diameter portion 22*c*, a plurality of (four, in the embodiment) small protrusions 22*g* are formed separately in the circumferential direction.

The tubular packing 24 is made of an elastic material such as silicone rubber, thermoplastic rubber, or synthetic rubber, and formed with a plurality of annular ribs 24*a* and 24*a* on the outer surface thereof. Each tubular packing 24 is inserted from an end portion on opposite-to-connection side of the male connector body 18 or the female connector body 20 and located inside the male connector body 18 or the female connector body 20. The tubular packing 24 has one end opposing the stepped portion 18*d* of the male connector body 18 or the stepped portion 20*d* of the female connector body 20 and the other end opposing the protruding end surface 22*e* of the tubular protrusion 22*d* of the nut 22.

The male connector body 18, the female connector body 20, and the nut 22 are made of a synthetic resin material having excellent weather resistance (such as a polycarbonate resin).

Figure 7:
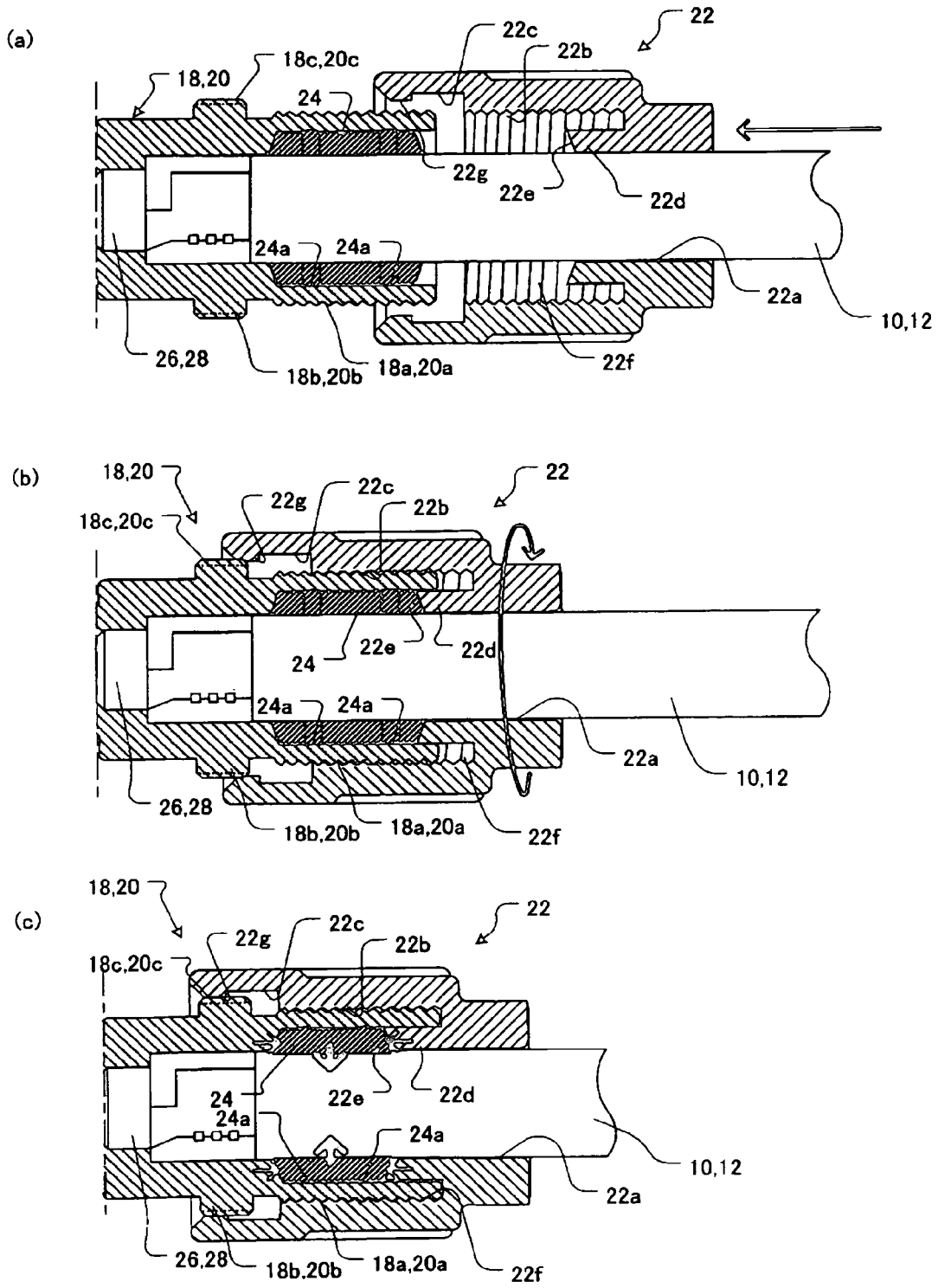
FIG. 7 is a sectional explanatory view showing a securing structure with a cable.

In order to secure a cable to the connector using the cable securing structure configured as described above, firstly the cable 10 or 12 is inserted through the nut 22, the tubular packing 24, and the male connector body 18 or the female connector body 20 while the nut 22 is unscrewed from the male connector body 18 or the female connector body 20 as shown in FIG. 7. Previously, a male contact 26 and a female contact 28 are respectively connected to the connection ends of the cable 10 and the cable 12.

Thereafter, the nut 22 is made to approach the male connector body 18 or the female connector body 20, and then the female thread 22*f* thereof is screwed on the male thread portion 18*a* or 20*a*. During this operation, the stepped portion 18*d* of the male connector body 18 or the stepped portion 20*d* of the female connector body 20 and the tubular protrusion 22*d* of the nut 22 approach each other so that the tubular packing 24 is compressed in the axial direction.

When the nut 22 is made to approach the male connector body 18 or the female connector body 20, the tip end hole 22*c* of the nut 22 reaches the enlarged diameter portion 18*b* of the male connector body 18 or the enlarged diameter portion 20*b* of the female connector body 20*b* so that the small protrusion 22*g* thereof interfere with the small protrusion 20*c*, thereby generating click feeling.

The nut 22 screwed on the male connector body 18 or the female connector body 20 as far as possible compresses the tubular packing 24 in the axial direction so that the tubular packing 24 has no space to go and expands toward the inner diameter side and the outer diameter side thereof. Therefore, the tubular packing 24 contacts the outer surface of the cable 10 or 12 and the inner surface of the male connector body 18 or the female connector body 20 with pressure and water-tightly secures them.

The tubular packing 24 presses whole of the cable 10 or 12, and thus can secure the connector to the cable 10 or 12 without locally applying pressure to the cable 10 or 12. Therefore, local dents can be prevented from being generated on the cable 10 or 12.

Since the protruding end surface 22*e* of the tubular protrusion 22*d* of the nut 22 and the inclined surface of the stepped portion 18*d* or 20*d* of the male connector body 18 or the female connector body 20 face the inner diameter side, they allow the tubular packing 24 to press towards the inner diameter direction with further pressure.

In addition, the annular ribs 24*a* and 24*a* formed on the outer surface of the tubular packing 24 can secure the pressure contact with the inner surface of the male connector body 18 or the female connector body 20.

Accordingly, the male connector body 18 can be secured to the cable 10, and the female connector body 20 can be secured to the cable 12, reliably.

After the connector is completely secured to the cable, the small protrusion 22*g* of the nut 22 interferes with the small protrusion 18*c* of the male connector body 18 or the small protrusion 20*c* of the female connector body 20 even if the nut 22 is loosened. Therefore, the nut 22 is prevented from being further loosened so that the connector can be kept secured to the cable 10 or 12.

(Structure for Preventing Return of Cable)

To the connection end side of the cable 10, a metal male contact 26 to be electrically connected to a core in the cable 10 is connected, and to the connection end side of the cable 12, a metal female contact 28 to be electrically connected to a core in the cable 12 is connected. On the outer surface of the male contact 26, a plurality of cut and raised pieces 26*a* are formed, and at the same time, on the outer surface of the female contact 28, a plurality of cut and raised pieces 28*a* are formed.

Inside the male connector body 18, holes having some diameters are continuously formed to match the shape of the cable 10 and the male contact 26. As one of the holes, a narrow throttle portion 18*e* having the minimum inner diameter is formed. Once the male contact 26 inserted from the side opposite to connection end passes the narrow portion 18*e*, the cut and raised pieces 26*a* engage with a stepped portion 18*f* formed on the connection end side of the narrow portion 18*e* so that the male contact 26 is prevented from returning.

Similarly, inside the female connector body 20, holes having some diameters are continuously formed to match the shape of the cable 12 and the female contact 28. As one of the holes, a narrow throttle portion 20*e* having the minimum inner diameter is formed. Once the female contact 28 inserted from the side opposite to connection end passes the narrow throttle portion 20*e*, the cut and raised pieces 28*a* engage with a stepped portion 20*f* formed on the connection end side of the narrow throttle portion 20*e* so that the female contact 28 is prevented from returning.

(Connection and Lock Structure)

Next, a lock mechanism for electrically connecting the male contact 26 of the cable 10 and the female contact 28 of the cable 12 and for mechanically locking the connection will be described.

On the connection end side of the male connector body 18, guide grooves 18*m* expanding in the outer diameter direction are formed at two positions (top and bottom) in the circumferential direction. On the wall surface of the middle portion of the guide grooves 18*m* in the axial direction, lock holes 18*n* penetrating from inside to outside of the guide grooves 18*m* are formed.

On the other hand, on the connection end side of the female connector body 20, guide protrusions 20*m* protruding in the outer diameter direction are formed at two positions (top and bottom) in the circumferential direction. Each of the guide protrusions 20*m* has both ends coupled to the outer surface of the female connector body 20, and the middle portion thereof in the axial direction that is separated from the outer surface of the female connector body 20 can be deformed in the inner diameter direction with resilient force so that the guide protrusion 20*m* comprises a flexible arm. On the middle portion of each guide protrusion 20*m* in the axial direction, a lock claw 20*n* protruding in the outer diameter direction is formed.

Adjacent to one end on the opposite-to-connection side of the guide protrusions 20*m*, a stopper 20*s* protruding in the outer diameter direction is formed. In addition, on the connection end side of the guide protrusion 20*m*, the female connector body 20 is formed with an annular groove 20*p*, in which an O-ring 30 is fitted.

Figure 8:
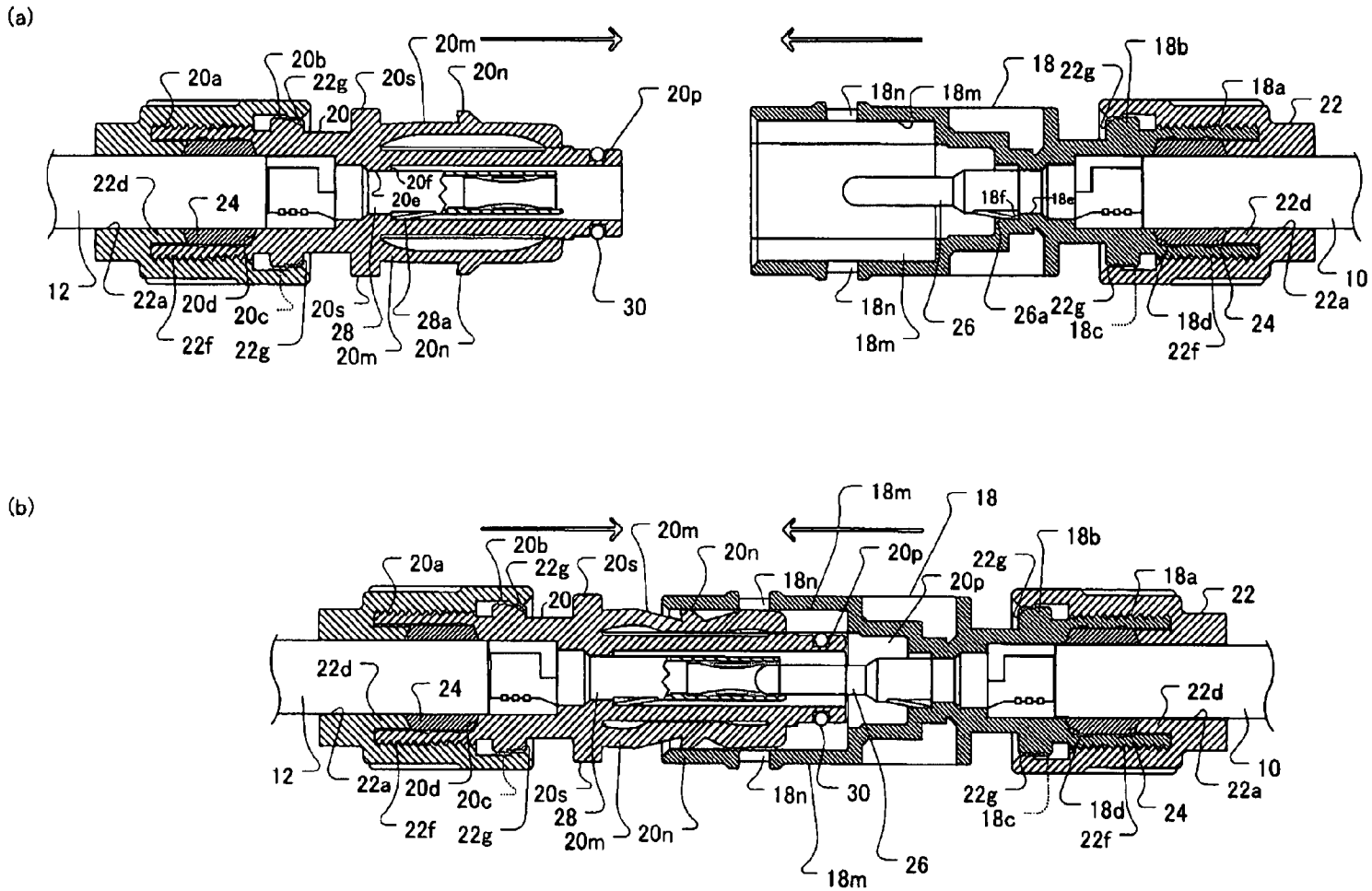
FIG. 8 is an explanatory view showing connection and lock operation of the male connector and the female connector.

In order to connect the male connector 14 and the female connector 16 described above, the male connector 14 and the female connector 16 are made to approach each other, and the guide protrusions 20*m* of the female connector body 20 is inserted into the guide grooves 18*m* of the male connector body 18 as shown in FIG. 8. The guide grooves 18*m* and the guide protrusions 20*m* are respectively formed on the connection end sides to correspond to each other, and thus they can be easily positioned.

When the lock claws 20*n* are inserted into the guide grooves 18*m*, the guide protrusions 20*m* bend to the inner diameter direction so that the lock claws 20*n* can move in the guide grooves 18*m*. When the lock claws 20*n* reach the lock holes 18*n*, the lock claws 20*n* engage with the lock holes 18*n* by restoring force of the guide protrusions 20*m*. At this time, the end of the male connector body 18, which corresponds to the end of the guide grooves 18*m*, abuts on the stopper 20*s* so as to limit further approach of the male connector 14 and the female connector 16. At the same time, the male contact 26 is inserted into the female contact 28 so as to secure the electrical connection therebetween.

Since the O-ring 30 contacts the inner surface of the male connector body 18 with pressure, the water-tightness between the male connector body 18 and the female connector body 20 can be secured.

The thus provided engagement of the lock claws 20*n* with the lock holes 18*n* can mechanically lock the connector. While the connector is locked, the guide protrusions 20*m* are completely housed in the guide grooves 18*m*, and thus the lock can be reliably kept. Therefore, a situation where the guide protrusions 20*m* inadvertently move to release the lock can be prevented.

In order to release the lock, the lock claws 20*n* are simultaneously displaced to the inner diameter direction from the respective lock holes 18*n* by using a jig so as to release the engagement, whereby the male connector 14 and the female connector 16 can be separated.

Since the guide protrusions 20*m* have both ends coupled to the outer surface of the female connector body 20, a larger force is needed to deform than that for a guide protrusion having only one end coupled to the outer surface of the female connector body 20 such as a cantilever arm. Because the lock claw 20*n* is moved to the lock holes 18*n* by deforming the guide protrusions 20*m* against the large restoring force, when the lock claws 20*n* reach the lock holes 18*n* and the restoring force is released, a large lock sound can be generated. Therefore, the large lock sound can tell a worker even while working outside that the lock is reliably performed.

In addition, since the restoring force of the guide protrusions 20*m* is large, the lock is not easily released, or when the connector is not yet connected, damage of the guide protrusions 20*m* can be prevented.

Since the guide grooves 18*m* and the guide protrusions 20*m* work as both a guide key mechanism and a lock mechanism, the whole structure can be made compact. Since the guide protrusions 20*m* have both ends coupled to the outer surface of the female connector body 20, the guide protrusions 20*m* themselves can suitably function as guide keys.

In the embodiment described above, the male connector body 18 is formed with the guide grooves 18*m* and the female connector body 20 is formed with the guide protrusions 20*m*, but the configuration is not limited thereto, and the female connector body 20 may be formed with a guide groove and the male connector body 18 may be formed with a guide protrusion.

Second Embodiment

Figure 9A:
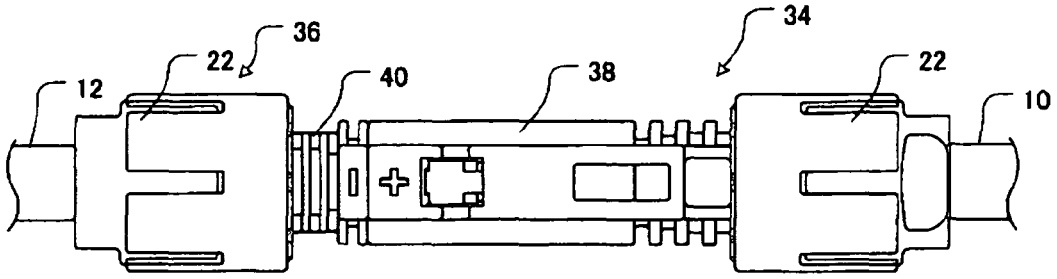
FIG. 9A is a plan view of a connector in a connection condition according to a second embodiment of the invention.
Figure 9B:
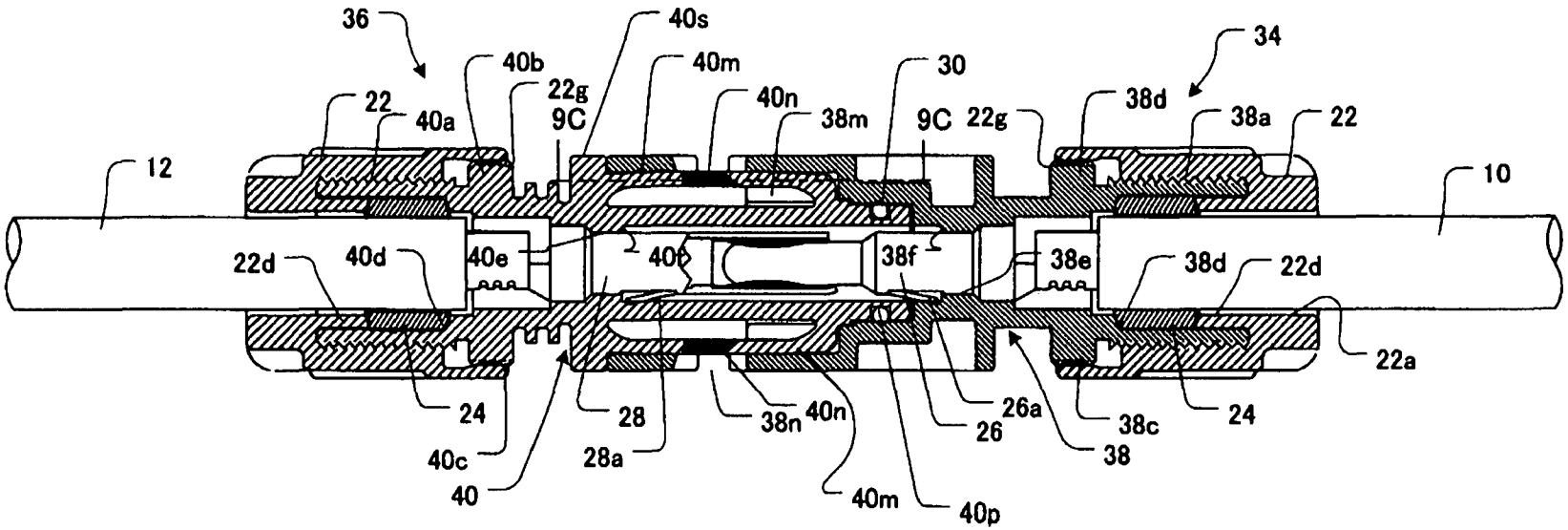
FIG. 9B is a sectional view of the connector in a connection condition according to the second embodiment of the invention.
Figure 9C:
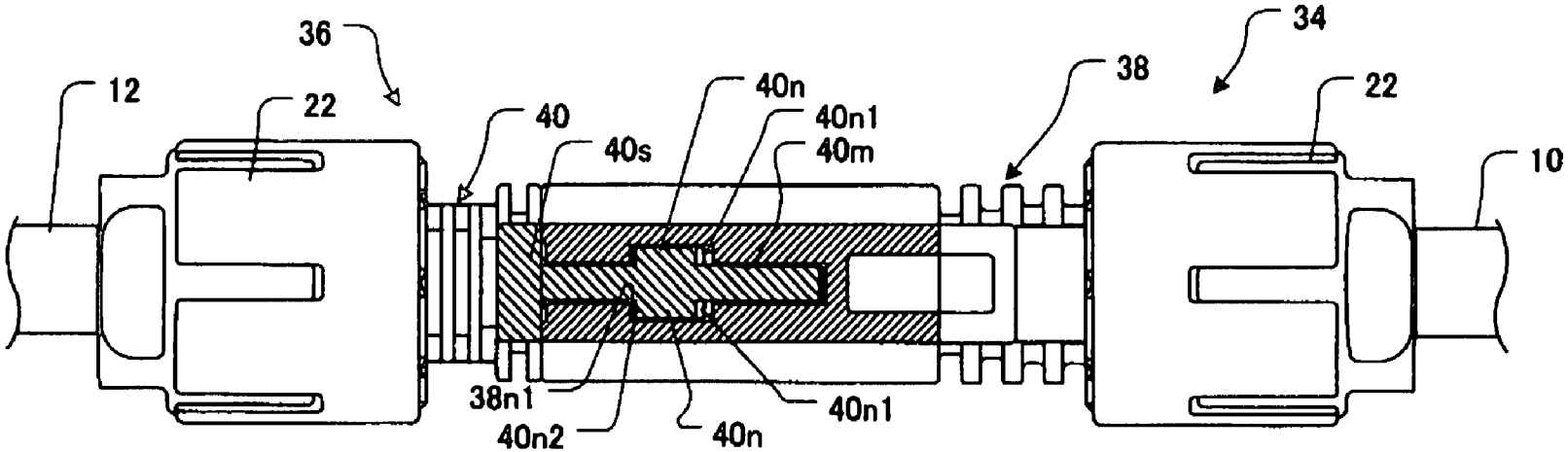
FIG. 9C is a partially sectional plan view taken along line 9C-9C of FIG. 9B.
Figure 10A:
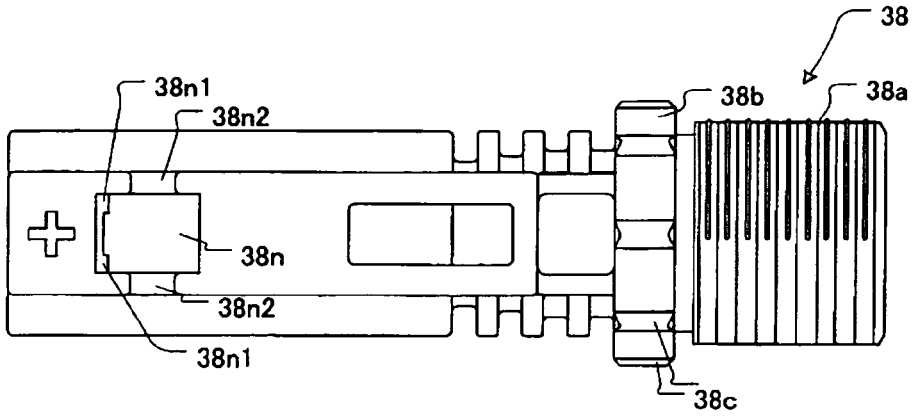
FIG. 10A is a plan view of a male connector body.
Figure 10B:
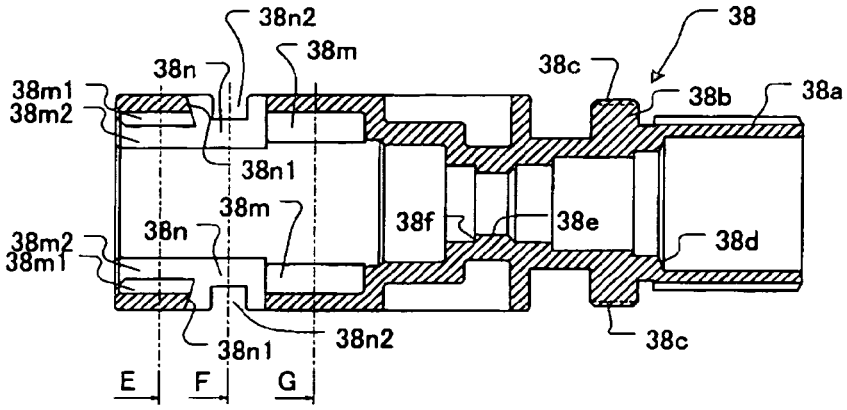
FIG. 10B is a longitudinal sectional view of the male connector body.
Figure 10C:
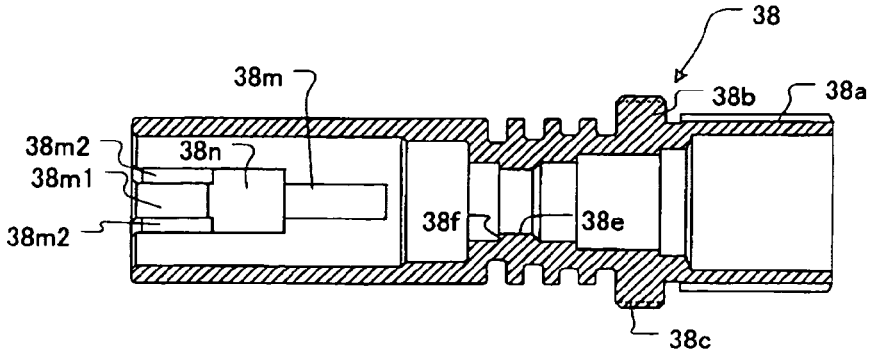
FIG. 10C is a longitudinal sectional view of the male connector body viewed from a section rotating 90 degrees from the section used in FIG. 10B.
Figure 10D:
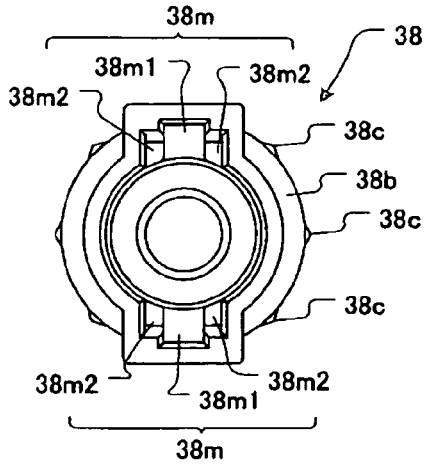
FIG. 10D is a view of the male connector body viewed from a connection end side.
Figure 10E:
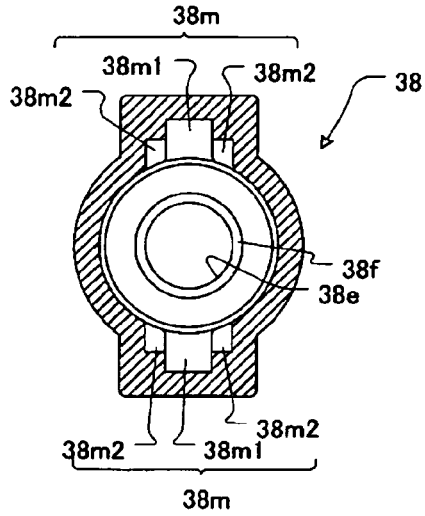
FIG. 10E is a sectional view taken along line E of FIG. 10B.
Figure 10F:
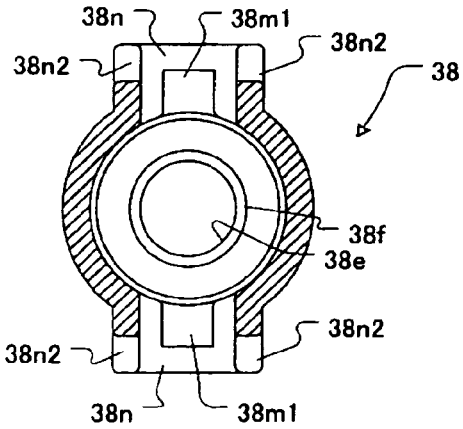
FIG. 10F is a sectional view taken along line F of FIG. 10B.
Figure 10G:
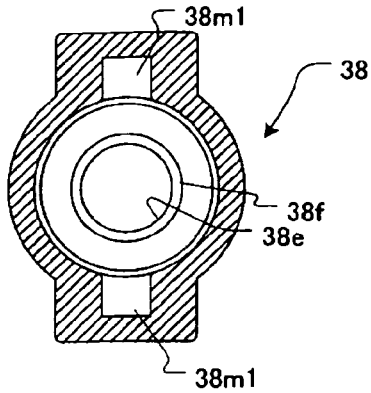
FIG. 10G is a sectional view taken along line G of FIG. 10B.
Figure 11A:
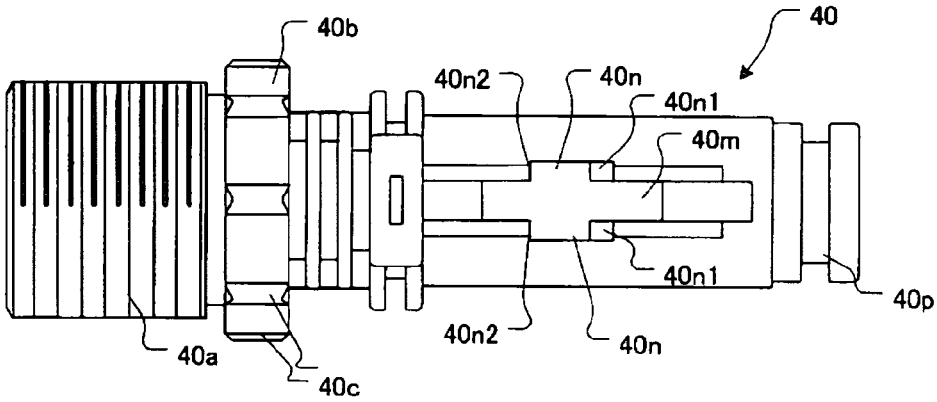
FIG. 11A is a plan view of a female connector body.
Figure 11B:
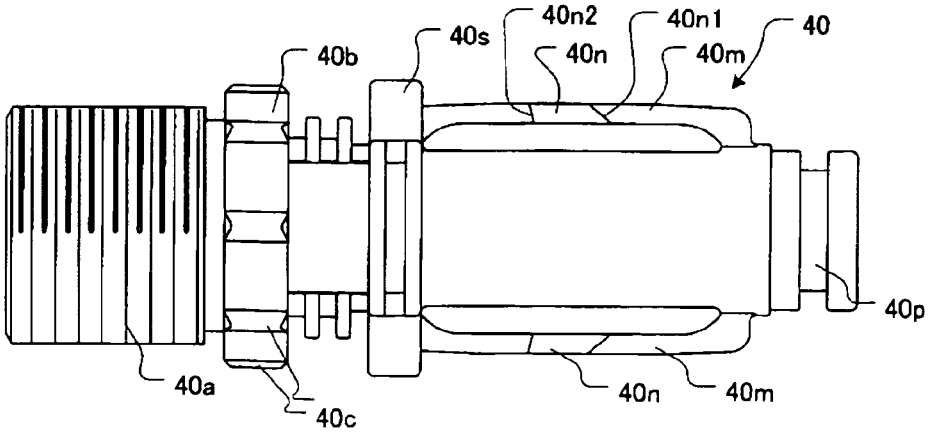
FIG. 11B is a side view of the female connector body.
Figure 11C:
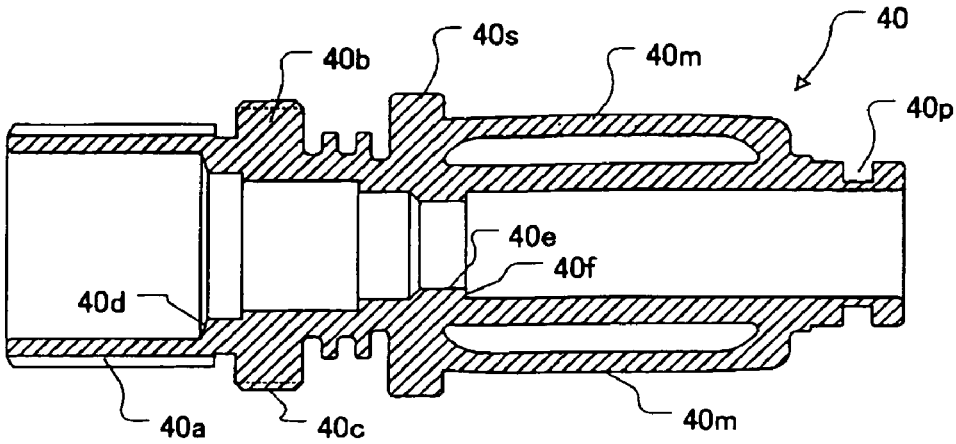
FIG. 11C is a longitudinal sectional view of the female connector body.
Figure 11D:
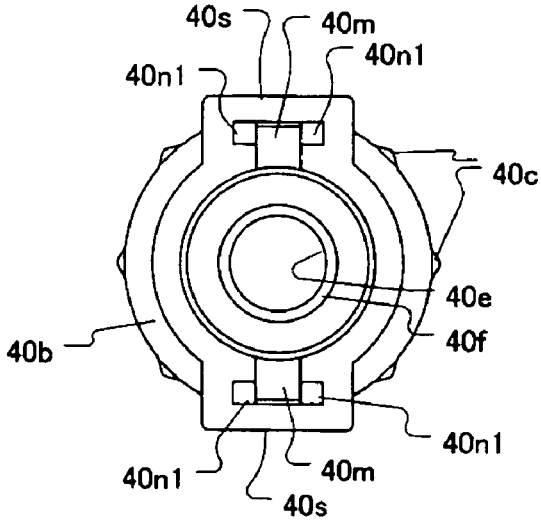
FIG. 11D is a view of the female connector body viewed from a connection end side.

FIGS. 9A to 9C are views showing a connector according to a second embodiment of the invention. In the embodiment, portions that are the same as or similar to those of the first embodiment are indicated by the same reference numerals and the detail explanation thereof will be omitted.

As shown in FIGS. 9A to 9C, the connector of the embodiment includes a male connector 34 and a female connector 36 respectively coupled to connection ends of cables 10 and 12 that are to be connected to each other.

The male connector 34 of a generally sleeve shape includes a male connector body 38 shown in FIGS. 10A to 10G, a nut 22 similar to that of the first embodiment, and a tubular packing 24 similar to that of the first embodiment.

Similarly, the female connector 36 of a generally sleeve shape includes, a female connector body 40 shown in FIGS. 11A to 11D, a nut 22 similar to that of the first embodiment, and a tubular packing 24 similar to that of the first embodiment.

The male connector 34 is configured to be water-tightly secured to the cable 10 by means of an end portion on opposite-to-connection side of the male connector body 38, the nut 22, and the tubular packing 24 similar to the first embodiment. The female connector 36 is configured to be water-tightly secured to the cable 12 by means of an end portion on opposite-to-connection side of the female connector body 40, the nut 22, and the tubular packing 24 similar to the first embodiment. Since the cable securing structure and the structure for preventing return of cable are the same as those in the first embodiment, the description thereof will be omitted. The male thread portion 18*a*, the enlarged diameter portion 18*b*, the small protrusion 18*c*, the stepped portion 18*d*, the narrow throttle portion 18*e*, and the stepped portion 18*f* of the male connector body 18 correspond to a male thread portion 38*a*, an enlarged diameter portion 38*b*, a small protrusion 38*c*, a stepped portion 38*d*, a narrow throttle portion 38*e*, and a stepped portion 38*f* of the male connector body 38. The male thread portion 20*a*, the enlarged diameter portion 20*b*, the small protrusion 20*c*, the stepped portion 20*d*, the narrow throttle portion 20*e*, and the stepped portion 20*f* of the female connector body 20 correspond to a male thread portion 40*a*, an enlarged diameter portion 40*b*, a small protrusion 40*c*, a stepped portion 40*d*, a narrow throttle portion 40*e*, and a stepped portion 40*f* of the female connector body 40. The male connector body 38 and the female connector body 40 are formed by a material similar to that of the male connector body 18 and the female connector body 20 in the first embodiment.

(Connection and Lock Structure)

A lock mechanism for electrically connecting the male contact 26 of the cable 10 and the female contact 28 of the cable 12, and for mechanically locking the connection will be described.

On the connection end side of the male connector body 38, guide grooves 38*m* expanding in the outer diameter direction are formed at two positions (top and bottom) in the circumferential direction. As shown in FIGS. 10B to 10G, each of the guide grooves 38*m* has a main groove 38*m*1 having a larger depth at the center of the guide groove 38*m* and side grooves 38*m*2 having a smaller depth on the both sides of the main groove 38*m*1 as viewed from the connection end side. The main groove 38*m*1 extends over the whole length of the guide groove 38*m* whereas the side grooves 38*m*2 extend only up to the middle portion of the guide groove 38*m* in the axial direction. Then, in the middle portion of the guide grooves 38*m* in the axial direction, lock holes 38*n* penetrating from inside to outside of the guide grooves 38*m* are formed. The wall surface of each of the lock holes 38*n* on the connection end side thereof, corresponding to upper portions of the side grooves 38*m*2 having a smaller depth, is configured as an engagement surface 38*n*1 inclined toward the outer diameter direction. The lock hole 38*n* has side holes 38*n*2 extending in a crossing direction perpendicular to the axial direction on both sides.

On the other hand, on the connection end side of the female connector body 40, guide protrusions 40*m* protruding in the outer diameter direction are formed at two positions (top and bottom) in the circumferential direction. Each of the guide protrusions 40*m* has both ends coupled to the outer surface of the female connector body 40, and the middle portion thereof in the axial direction that is separated from the outer surface of the female connector body 40 can be deformed in the inner diameter direction with resilient force so that the guide protrusion 40*m* comprises a flexible arm. On the middle portion of each guide protrusion 40*m* in the axial direction, lock claws 40*n* protruding in the side direction are formed. An end surface 40*n*1 on the connection end side of each of the lock claws 40*n* is inclined toward the outer diameter direction, and an end surface 40*n*2 on the side opposite to connection end of the lock claw 40*n* is inclined toward the inner diameter direction (See FIG. 11B).

Adjacent to one end on the opposite-to-connection side of the guide protrusions 40*m*, a stopper 40*s* protruding in the outer diameter direction is formed. In addition, on the connection end side of the guide protrusion 40*m*, the female connector body 40 is formed with an annular groove 40*p* in which an O-ring 30 is fitted.

Figure 12:
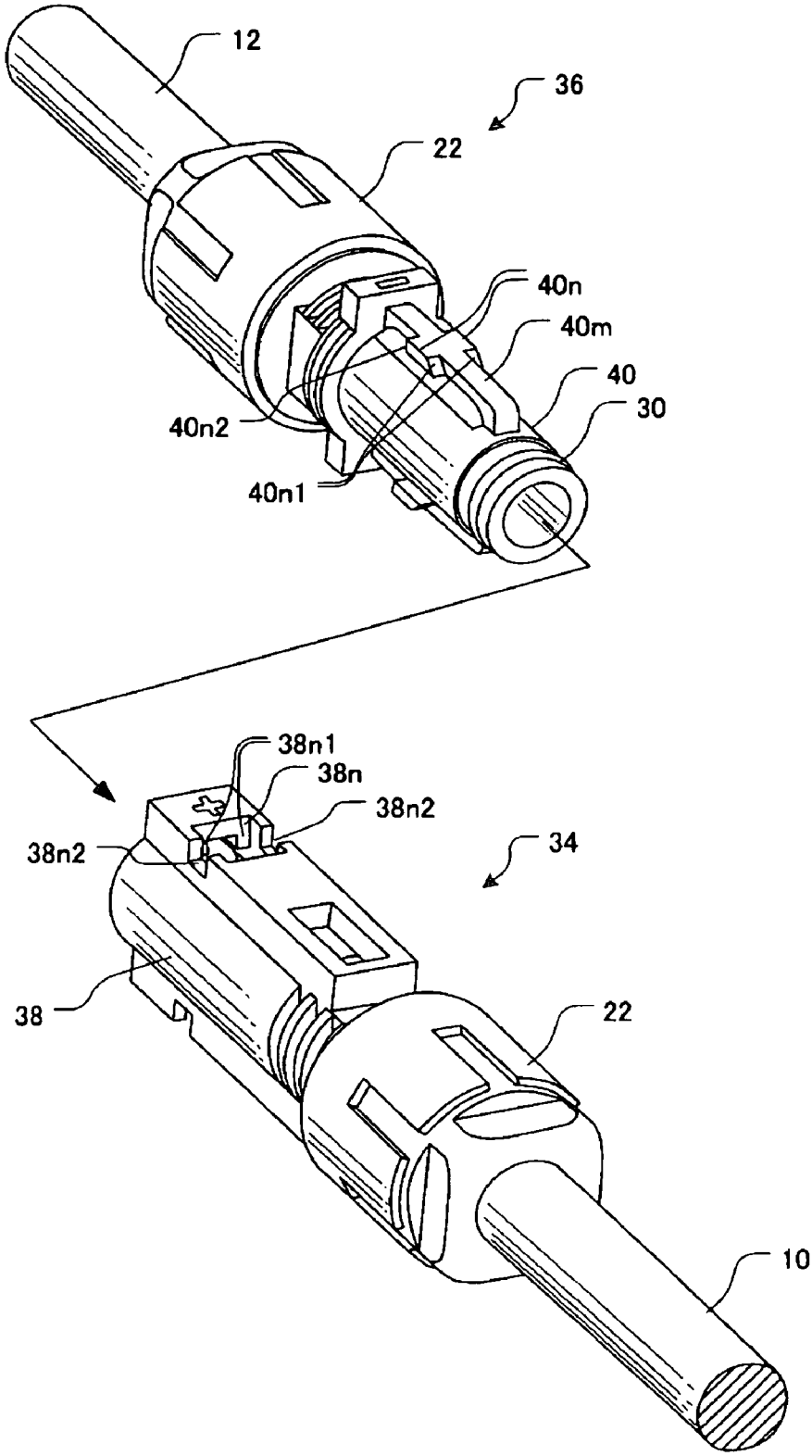
FIG. 12 is a perspective view showing connection and lock operation of the male connector and the female connector.

In order to connect the male connector 34 and the female connector 36 as described above, the male connector 34 and the female connector 36 are made to approach each other as shown in FIG. 12, and the guide protrusions 40*m* of the female connector body 40 are inserted into the guide grooves 38*m* of the male connector body 38. The guide grooves 38*m* and the guide protrusions 40*m* are respectively formed on the connection end sides to correspond to each other, and thus they can be easily positioned.

The width of each of the guide protrusions 40*m* generally matches the width of the main groove 38*m*1 of the guide groove 38*m* so that the guide protrusion 40*m* can move in the main groove 38*m*1. However, the lock claw 40*n* once inserted in the guide groove 38*m* cannot move in the main groove 38*m*1, and thus the guide protrusion 40*m* bends in the inner diameter direction so that the lock claw 40*n* can move in the side grooves 38*m*2. At this time, the lock claw 40*n* can be smoothly guided into the guide groove 38*m* and, at the same time, the guide protrusion 40*m* can bend toward the inner diameter direction since the end surface 40*n*1 of the lock claw 40*n* is formed as an inclined surface. When the lock claw 40*n* thus reaches the lock hole 38*n*, the lock claw 40*n* engages with the lock hole 38*n* by restoring force of the guide protrusion 40*m*. More specifically, the end surface 40*n*2 of the lock claw 40*n* abuts on or engages with the engagement surface 38*n*1 of the lock hole 38*n*. At this time, the end of the male connector body 38, which corresponds to the end of the guide grooves 38*m*, abuts on the stopper 40*s* so as to limit further approach of the male connector 34 and the female connector 36. At the same time, the male contact 26 is inserted into the female contact 28 so as to secure the electrical connection therebetween.

Since the O-ring 30 contacts the inner surface of the male connector body 38 with pressure, the water-tightness between the male connector body 38 and the female connector body 40 can be secured.

The thus provided engagement of the lock claws 40*n* with the lock holes 38*n* can mechanically lock the connector. While the connector is locked, the guide protrusions 40*m* are completely housed in the guide grooves 38*m*, and thus the lock can be reliably kept. The two lock claws 40*n* respectively engage with the lock holes 38*n* for each of the guide protrusions 40*m*, and thus four lock claws 40*n* on top and bottom respectively engage with the lock holes 38*n*. Therefore, a situation where the guide protrusions 40*m* inadvertently move to release the lock can be prevented even when the connectors are respectively pulled leftward and rightward. In addition, end surfaces 40*n*2 of the lock claws 40*n* and the engagement surfaces 38*n*1 of the lock holes 38*n* that can engage with each other are formed as inclined surfaces and the inclined surfaces are formed to make acute angles with the direction in which the guide protrusions 40*m* move toward the side opposite to connection end. Therefore, the connectors are configured not to easily cause the guide protrusions 40*m* to move toward the side opposite to connection end.

In order to release the lock, a jig is used to deform each of the lock claws 40*n* at the same time by appropriately utilizing the side holes 38*n*2 of each of the lock holes 38*n* so as to release the engagement, whereby the male connector 34 and the female connector 36 can be separated.

According to the embodiment, the effect similar to the first embodiment can be provided and at the same time, stronger lock can be achieved since the lock claws 40*n* are provided on both side of each of the guide protrusions 40*m*.

Also in the embodiment, the male connector body 38 is formed with the guide grooves 38*m* and the female connector body 40 is formed with the guide protrusions 40*m*, but the configuration is not limited thereto, and the female connector body 40 may be formed with a guide groove and the male connector body 38 may be formed with a guide protrusion.

REFERENCE SIGNS LIST

10, 12 cable
14, 34 male connector (first connector)
16, 36 female connector (second connector)
18, 38 male connector body
18*d*, 38*d* stepped portion
18*m*, 38*m* guide groove
18*n*, 38*n* lock hole
20, 40 female connector body
20*d*, 40*d* stepped portion
20*m*, 40*m* guide protrusion
20*n*, 40*n* lock claw
22 nut
22*d* tubular protrusion
22*e* protruding end surface
24 tubular packing

The invention claimed is:

1. A connector including a first connector and a second connector both of which have a sleeve shape and are coupled to connection ends of cables to be connected to each other, a connection end of either one of the first connector and the second connector being inserted into the connection end of the other one thereof so that the cables are connected to each other, wherein the first connector is provided with at least one guide groove extending in an insertion direction on a portion in a circumferential direction, and the second connector is provided with at least one guide protrusion that extends in the insertion direction and can be inserted into the guide groove corresponding to the guide groove, the guide protrusion has both ends coupled to an outer surface of the second connector, and a middle portion thereof is formed to be an elastic arm separated from the outer surface, a lock mechanism is provided between the guide groove and the guide protrusion, the lock mechanism includes a lock hole formed from the guide groove and a lock claw that is formed on the guide protrusion and can engage with the lock hole, and the lock claw is provided on each of both sides of the guide protrusion and the lock claw and the lock hole engage with each other on both sides of the guide protrusion.

2. The connector according to claim 1, wherein an end surface on a side opposite to connection end of the lock claw is inclined toward an inner diameter direction, and an engagement surface of the lock hole engaging with the end surface is inclined toward an outer diameter direction.

3. The connector according to claim 1, wherein each of the first connector and the second connector includes:

a body;

a nut screwed on an end portion on opposite-to-connection side of the body; and a tubular packing which is located inside the body and through which the cable is inserted, wherein the tubular packing is compressed in an axial direction as the nut is screwed on the body so as to water-tightly contact the cable with pressure.

4. The connector according to claim 3, wherein a plurality of protrusions are formed on a circumferential surface of the body separately in the circumferential direction, a plurality of protrusions are formed on a circumferential surface of the nut, and the nut and the body rotate relatively to each other while the protrusion of the nut interferes with the protrusion of the body as the nut is screwed on the body.

5. The connector according to claim 3, wherein a stepped portion that abuts on one end of the tubular packing is provided in the body, and a tubular protrusion protruding in the axial direction is formed inside the nut so as to abut on the other end of the tubular packing.

6. The connector according to claim 5, wherein the stepped portion and a protruding end surface of the tubular protrusion are formed as inclined surfaces that are inclined to face an inner diameter side.

* * * * *